US012575653B2

(12) United States Patent
Park

(10) Patent No.: US 12,575,653 B2
(45) Date of Patent: Mar. 17, 2026

(54) CASE INCLUDING STRUCTURE FOR SUPPORTING ELECTRONIC DEVICE

(71) Applicant: SAMSUNG ELECTRONICS CO., LTD., Suwon-si (KR)

(72) Inventor: Sunghan Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 313 days.

(21) Appl. No.: 18/199,687

(22) Filed: May 19, 2023

(65) Prior Publication Data

US 2024/0065397 A1 Feb. 29, 2024

Related U.S. Application Data

(63) Continuation of application No. PCT/KR2023/006306, filed on May 9, 2023.

(30) Foreign Application Priority Data

Aug. 30, 2022 (KR) ..... 10-2022-0109441
Sep. 22, 2022 (KR) ..... 10-2022-0119768

(51) Int. Cl.
*A45C 11/00* (2006.01)
*A45C 13/00* (2006.01)

(52) U.S. Cl.
CPC ..... *A45C 13/005* (2013.01); *A45C 11/002* (2025.01); *A45C 11/003* (2025.01); *A45C 2200/15* (2013.01)

(58) Field of Classification Search
CPC ..... A45C 11/00; A45C 13/005; A45C 11/002; A45C 11/003; A45C 2200/15;
(Continued)

(56) References Cited

U.S. PATENT DOCUMENTS 2,383,776 A * 8/1945 Cross ..... G09F 1/14 248/459
3,097,444 A * 7/1963 Steiner ..... A47B 23/043 248/459

(Continued)

FOREIGN PATENT DOCUMENTS

JP 3178092 U 8/2012
JP 2017-68732 A 4/2017

(Continued)

OTHER PUBLICATIONS

International Search Report dated Aug. 22, 2023 issued by the International Searching Authority in International Application No. PCT/KR2023/006306.

(Continued)

*Primary Examiner* — Kimberly T Wood
(74) *Attorney, Agent, or Firm* — Sughrue Mion, PLLC

(57) ABSTRACT

A case coupled to an electronic device incudes a base including a supporting surface, a moving plate including a first supporting member and a second supporting member thicker than the first supporting member and movable on the second surface of the base with respect to the base, wherein a state of the moving plate includes a first state and a second state, wherein a side surface of the second supporting member and the supporting surface inclined with respect to the rotational axis faces each other within the first state, and faces the inner surface of the first supporting member or a side surface of the first supporting member perpendicular to the inner surface of the first supporting member, by a movement of the second supporting member with respect to the first supporting member within the second state.

20 Claims, 8 Drawing Sheets

(58) Field of Classification Search
CPC ..... A45C 13/00; H01F 7/02; H04B 1/3888; H04M 1/04; F16M 13/00
USPC ..... 248/688
See application file for complete search history.

(56) References Cited

U.S. PATENT DOCUMENTS

| | | | | |
|---|---|---|---|---|
| D726,192 | S * | 4/2015 | Massucco | D14/440 |
| 9,332,813 | B2 * | 5/2016 | Jiang | A45C 11/00 |
| 9,451,818 | B2 * | 9/2016 | Buechin | A45C 13/005 |
| 10,827,591 | B2 | 11/2020 | Wun et al. | |
| 11,275,410 | B1 | 3/2022 | Hosokai et al. | |
| 11,307,612 | B2 | 4/2022 | Hosokai et al. | |
| 2012/0305413 | A1 * | 12/2012 | Chung | A45C 11/00 206/320 |
| 2014/0004915 | A1 | 1/2014 | Huang | |
| 2015/0151871 | A1 | 6/2015 | Huang | |
| 2015/0296643 | A1 * | 10/2015 | Lee | A45C 13/1069 206/45.2 |
| 2015/0305459 | A1 * | 10/2015 | Lee | A45C 11/00 224/577 |
| 2015/0372708 | A1 * | 12/2015 | Chiou | H04B 1/3888 455/575.8 |
| 2016/0099740 | A1 * | 4/2016 | Kim | H04M 1/04 455/575.8 |
| 2016/0134322 | A1 | 5/2016 | Lee et al. | |
| 2016/0366997 | A1 * | 12/2016 | Sirichai | A45C 11/00 |
| 2018/0049529 | A1 * | 2/2018 | Buechin | G09G 3/3413 |
| 2020/0121046 | A1 * | 4/2020 | Buechin | A45C 11/00 |
| 2020/0297089 | A1 * | 9/2020 | Yen | A45C 13/005 |
| 2021/0037666 | A1 * | 2/2021 | Kang | G06F 1/1633 |
| 2022/0142315 | A1 * | 5/2022 | Wang | H02J 50/00 |
| 2023/0009746 | A1 * | 1/2023 | Liu | G06F 1/1628 |
| 2023/0044946 | A1 * | 2/2023 | Watamura | G06F 1/1626 |
| 2023/0148721 | A1 * | 5/2023 | Lee | H04M 1/185 224/183 |
| 2023/0363505 | A1 | 11/2023 | Lee et al. | |
| 2024/0341427 | A1 * | 10/2024 | Oldani | H01F 7/02 |

FOREIGN PATENT DOCUMENTS

| | | | |
|---|---|---|---|
| JP | 2018-105961 | A | 7/2018 |
| JP | 2019-525352 | A | 9/2019 |
| KR | 10-1240616 | B1 | 3/2013 |
| KR | 10-1608931 | B1 | 4/2016 |
| KR | 10-2022-0012147 | A | 2/2022 |
| KR | 10-2022-0102927 | A | 7/2022 |
| TW | 201404109 | A | 1/2014 |
| WO | 2022/019520 | A1 | 1/2022 |

OTHER PUBLICATIONS

Communication dated Jul. 18, 2025, issued by the European Patent Office in European Application No. 23860590.1.

* cited by examiner

CASE INCLUDING STRUCTURE FOR SUPPORTING ELECTRONIC DEVICE

CROSS-REFERENCE TO RELATED APPLICATIONS

This application is a continuation of International Application No. PCT/KR2023/006306 designating the United States, filed on May 9, 2023, in the Korean Intellectual Property Receiving Office, and claiming priority to Korean Patent Application No. 10-2022-0109441, filed on Aug. 30, 2022, in the Korean Intellectual Property Office, and Korean Patent Application No. 10-2022-0119768, filed on Sep. 22, 2022, in the Korean Intellectual Property Office, the disclosures of which are incorporated by reference herein in their entireties.

BACKGROUND

1. Field

The disclosure relates to a case including a structure for supporting an electronic device.

2. Description of Related Art

An electronic device may be exposed to various environments as it is carried by a user. A case is detachably coupled to the electronic device, thereby protecting the electronic device exposed to various environments. For example, the case may protect the electronic device from the impact transmitted to the electronic device from the outside of the electronic device. In order to meet a user's demand, the case may have various functions other than a function to protect the electronic device.

SUMMARY

According to an embodiment, a case configured to be detachably coupled to an electronic device may comprise a base including a first surface supporting the electronic device, a second surface opposite to the first surface, and the supporting surface connecting the first surface and the second surface. According to an embodiment, the case may comprise a moving plate including a first supporting member and a second supporting member thicker than the first supporting member and configured to be movable with respect to the first supporting member. According to an embodiment, the moving plate configured to be rotatable with respect to the base about a rotational axis to position the moving plate in a first state with respect to the base and position the moving plate in a second state with respect to the base. According to an embodiment, in the first state, an inner surface of the first supporting member and the second surface of the base are parallel to each other, and a side surface of the second supporting member and the supporting surface, which is inclined with respect to the rotational axis, face each other. According to an embodiment, in the second state, a direction in which the inner surface of the first supporting member is facing is inclined with respect to a direction in which the second surface is facing, and the side surface of the second supporting member faces, by a movement of the second supporting member with respect to the first supporting member, the inner surface of the first supporting member or a side surface of the first supporting member perpendicular to the inner surface of the first supporting member.

According to an embodiment, a case configured to be detachably coupled to an electronic device may comprise a base including a first surface supporting the electronic device, a second surface opposite to the first surface, and the supporting surface connecting the first surface and the second surface. According to an embodiment, the case may comprise a hinge disposed on the second surface and defining a rotational axis. According to an embodiment, the case may comprise a moving plate including a first supporting member and a second supporting member thicker than the first supporting member and movable with respect to the first supporting member. According to an embodiment, the moving plate coupled to a first part of the hinge and configured to be rotatable with respect to the base about the rotational axis to position the moving plate in a first state with respect to the base and position the moving plate in a second state with respect to the base. According to an embodiment, the case may comprise a connecting plate to be coupled to a second part of the hinge. According to an embodiment, in the first state, an inner surface of the first supporting member and the second surface of the base are to parallel each other, and a side surface of the second supporting member and the supporting surface, which is inclined with respect to the rotational axis, face each other. According to an embodiment, in the second state, a direction in which the inner surface of the first supporting member is facing is inclined with respect to a direction in which the second surface is facing, and the side surface of the second supporting member faces, by a movement of the second supporting member with respect to the first supporting member the inner surface of the first supporting member or a side surface of the first supporting member perpendicular to the inner surface.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1A:
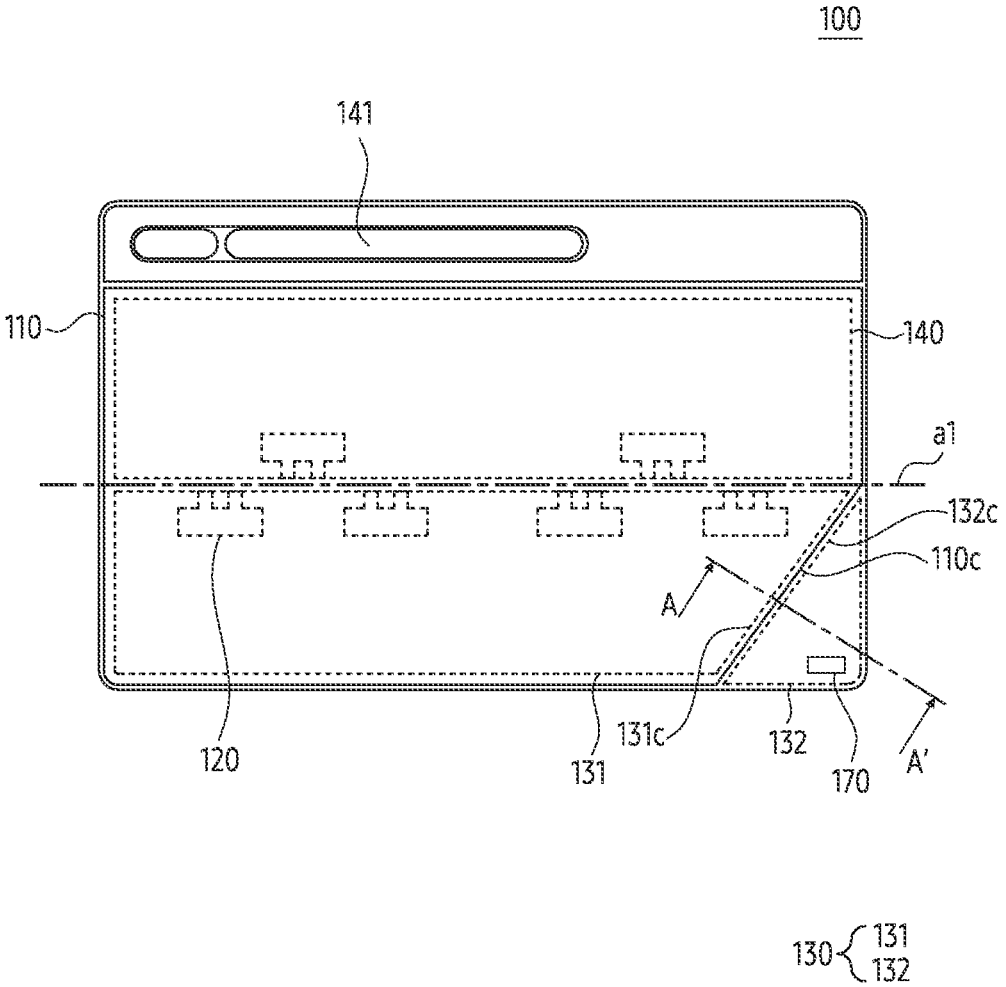
FIG. 1A is a top plan view of an exemplary case according to an embodiment in a first state.

Hereinafter, various embodiments of the disclosure will be described with reference to accompanying drawings. Accordingly, those of ordinary skill in the art will recognize that modification, equivalent, and/or alternative on the various embodiments described herein can be variously made without departing from the scope and spirit of the disclosure.

With regard to description of the drawings, identical or similar reference numerals may be used to refer to identical or similar components.

Figure 1B:
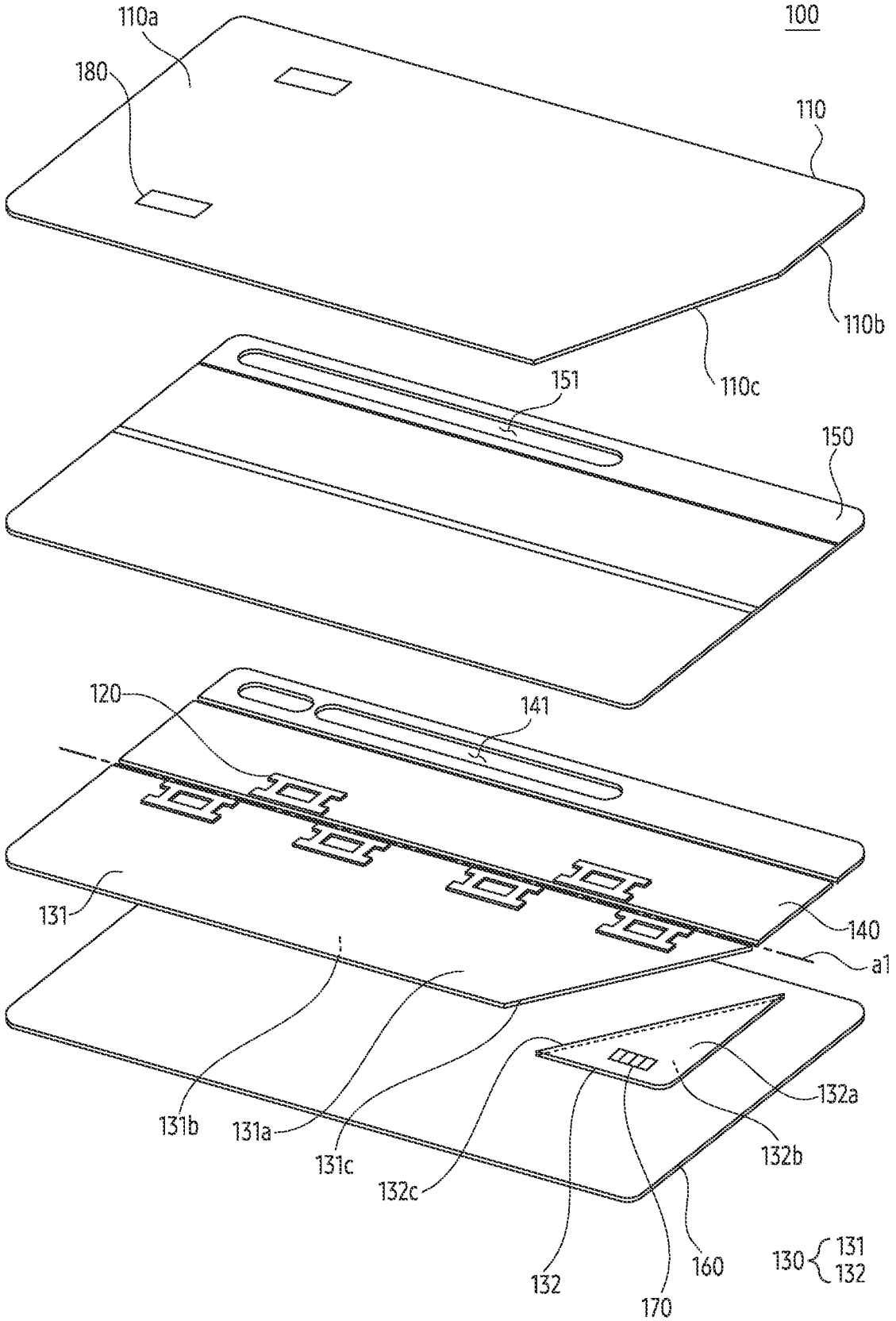
FIG. 1B is an exploded perspective view of an exemplary case according to an embodiment.

FIG. 1A is a top plan view of a case 100 according to an embodiment in a first state, and FIG. 1B is an exploded perspective view of a case 100 according to an embodiment.

Referring to FIG. 1A and FIG. 1B, according to an embodiment, a case 100 may include a base 110, at least one hinge 120, a moving plate 130, a connecting plate 140, a first covering member 150, a second covering member 160, a first magnet 170, and/or a second magnet 180. According to an embodiment, the case 100 may be detachably coupled to an electronic device. The case 100 may protect the electronic device while being coupled to the electronic device.

The base 110 may contact one surface of the electronic device in a state of being coupled with the electronic device. For example, the base 110 may be made of a material having rigidity, but is not limited thereto. According to embodiments, the base 110 may be made of a material having flexibility. According to an embodiment, the base 110 may include a first surface 110*a*, a second surface 110*b*, and a supporting surface 110*c*. The first surface 110*a* may support the electronic device in a state in which the case 100 and the electronic device are coupled. For example, the first surface 110*a* may face the electronic device in a state in which the case 100 and the electronic device are coupled. The second surface 110*b* may be opposite to the first surface 110*a*. A direction in which the second surface 110*b* faces may be opposite to a direction in which the first surface 110*a* faces. The second surface 110*b* may be spaced apart from the first surface 110*a*. For example, the second surface 110*b* may be parallel to the first surface 110*a*. The supporting surface 110*c* may connect the first surface 110*a* and the second surface 110*b*. The supporting surface 110*c* may extend between the first surface 110*a* and the second surface 110*b*. For example, the supporting surface 110*c* may be perpendicular to the first surface 110*a* and the second surface 110*b*. According to an embodiment, the supporting surface 110*c* may have a slope with respect to a rotational axis al. For example, the supporting surface 110*c* may extend in a direction inclined with respect to the rotational axis al.

The at least one hinge 120 may connect the moving plate 130 and the connecting plate 140. For example, a part of at least one hinge 120 may be connected to the moving plate 130. Another part of the at least one hinge 120 may be connected to the connecting plate 140. According to an embodiment, the at least one hinge 120 may provide a rotational axis al of the moving plate 130. For example, the at least one hinge 120 may provide the rotational axis al so that the moving plate 130 may rotate with respect to the base 110. The rotational axis al may be defined between the moving plate 130 and the connecting plate 140. According to an embodiment, the at least one hinge 120 may be disposed on the second surface 110*b* of the base 110. As the at least one hinge 120 is disposed on the second surface 110*b*, the rotational axis al defined by the at least one hinge 120 may be defined on the second surface 110*b* of the base 110.

The moving plate 130 may be movable with respect to the base 110. For example, the moving plate 130 may be rotatable with respect to the base 110. According to an embodiment, the moving plate 130 may be disposed on the second surface 110*b* of the base 110. The moving plate 130 may be rotated with respect to the base 110 based on the rotational axis al on the second surface 110*b* of the base 110. According to an embodiment, the moving plate 130 may include a first supporting member 131 and a second supporting member 132. According to an embodiment, the moving plate 130 may be deformable by an external force. The moving plate 130 may have flexibility. For example, the moving plate 130 may include epoxy, but is not limited thereto.

The first supporting member 131 may be disposed on the second surface 110*b* of the base 110. According to an embodiment, the first supporting member 131 may be coupled to the at least one hinge 120. The first supporting member 131 may be rotatable with respect to the base 110. For example, the first supporting member 131 may be rotatable with respect to the connecting plate 140 based on the rotational axis al defined by the at least one hinge 120. According to an embodiment, the first supporting member 131 may be covered by the first covering member 150. For example, an inner surface 131*a* of the first supporting member 131 may face the first covering member 150. An outer surface 131*b* of the first supporting member 131 opposite to the inner surface 131*a* of the first supporting member 131 may be covered by the second covering member 160. A direction in which the outer surface 131*b* of the first supporting member 131 faces may be opposite to a direction in which the inner surface 131*a* of the first supporting member 131 faces. A side surface 131*c* of the first supporting member 131 may be disposed between the inner surface 131*a* of the first supporting member 131 and the outer surface 131*b* of the first supporting member 131. The side surface 131*c* of the first supporting member 131 may connect the inner surface 131*a* of the first supporting member 131 and the outer surface 131*b* of the first supporting member 131. For example, the side surface 131*c* of the first supporting member 131 may be perpendicular to the inner surface 131*a* of the first supporting member 131 and the outer surface 131*b* of the first supporting member 131. According to an embodiment, the side surface 131*c* of the first supporting member 131 may have a slope with respect to the rotational axis al. For example, the side surface 131*c* of the first supporting member 131 may extend in a direction inclined with respect to the rotational axis al.

The second supporting member 132 may be coupled to the first supporting member 131. For example, the second supporting member 132 may be spaced apart from the first supporting member 131. The second supporting member 132 spaced apart from the first supporting member 131 may be coupled to the first supporting member 131 through the first covering member 150 and the second covering member 160. According to an embodiment, the second supporting member 132 may be movable with respect to the first supporting member 131. The second supporting member 132 may be foldable with respect to the first supporting member 131. For example, the second supporting member 132 may be movable with respect to the first supporting member 131 based on a direction in which the supporting surface 110*c* of the base 110 extends. For example, the second supporting member 132 may be movable with respect to the first supporting member 131 based on a direction in which the side surface 131*c* of the first supporting member 131 is extended. According to an embodiment, the second supporting member 132 may be covered by the first covering member 150. For example, the inner surface 132*a* of the second supporting member 132 may face the first covering member 150. The outer surface 132*b* of the second supporting member 132 opposite to the inner surface 132*a* of the second supporting member 132 may be covered by the second covering member 160. A direction in which the outer surface 132*b* of the second supporting member 132 faces may be opposite to a direction in which the inner surface 132*a* of the second supporting member 132 faces. The side surface 132*c* of the second supporting member 132 may be disposed between the inner surface 132*a* of the second supporting member 132 and the outer surface 132*b* of the second supporting member 132. The side surface 132*c* of the second supporting member 132 may connect the inner surface 132*a* of the second supporting member 132 and the outer surface 132*b* of the second supporting member 132. For example, the side surface 132*c* of the second supporting member 132 may be perpendicular to the inner surface 132*a* of the second supporting member 132 and the outer surface 132*b* of the second supporting member 132. According to an embodiment, the side surface 132*c* of the second supporting member 132 may have a slope with respect to the rotational axis al. For example, the side surface 132*c* of the second supporting member 132 may extend in the direction inclined with respect to the rotational axis al. According to an embodiment, the second supporting member 132 may face the connecting plate 140 based on the rotational axis al. For example, the rotational axis al may be disposed between the second supporting member 132 and the connecting plate 140. For example, the rotational axis al may be disposed between the first supporting member 131 and the connecting plate 140.

The connecting plate 140 may be coupled to the base 110. For example, the connecting plate 140 may be disposed on the second surface 110*b* of the base 110. According to an embodiment, the connecting plate 140 may be fixed to the base 110. For example, the connecting plate 140 may be attached to the base 110. As the connecting plate 140 is fixed to the base 110, the moving plate 130 may rotate with respect to the connecting plate 140. According to an embodiment, the connecting plate 140 may include an accommodating groove 141. The accommodating groove 141 may accommodate an electronic pen distinguished from the electronic device. The accommodating groove 141 may be disposed on the connecting plate 140. For example, the accommodating groove 141 may be formed by being recessed a part of the connecting plate 140 into the connecting plate 140. According to an embodiment, the connecting plate 140 may be made of different materials. For example, a part of the connecting plate 140 facing the base 110 may be made of a material having flexibility. For example, the part of the connecting plate 140 may include epoxy. For example, another part of the connecting plate 140 in which the accommodating groove 141 is formed may be made of a material having rigidity. For example, another part of the connecting plate 140 may be manufactured by an injection process using a molten resin. According to an embodiment, the other part of the connecting plate 140 in which the accommodating groove 141 is formed may be exposed to the outside of the base 110. For example, a part of the connecting plate 140 in which the accommodating groove 141 is formed may not be covered by the second surface 110*b* of the base 110.

The first covering member 150 may cover the at least one hinge 120, the moving plate 130, and the connecting plate 140. According to an embodiment, the first covering member 150 may connect the first supporting member 131 and the second supporting member 132. For example, the first covering member 150 may cover the first supporting member 131 and the second supporting member 132. The first covering member 150 may be disposed on the second surface 110*b* of the base 110. When the moving plate 130 moves, a part of the first covering member 150 covering the moving plate 130 may move with the moving plate 130. Another part of the first covering member 150 covering the connecting plate 140 may be attached to the base 110. The other part of the first covering member 150 covering the connecting plate 140 may be fixed to the base 110 when the moving plate 130 moves. The first covering member 150 may be disposed between the base 110 and the moving plate 130. According to an embodiment, the first covering member 150 may include an opening 151 corresponding to the accommodating groove 141. The opening 151 may be opened toward the outside of the base 110 to accommodate the electronic pen of the electronic device.

The second covering member 160 may define a part of the outer surface of the case 100. The second covering member 160 may cover the at least one hinge 120, the moving plate 130, and the connecting plate 140. According to an embodiment, the second covering member 160 may connect the first supporting member 131 and the second supporting member 132. For example, the second covering member 160 may cover the first supporting member 131 and the second supporting member 132. The second covering member 160 may be disposed on the second surface 110*b* of the base 110. According to an embodiment, a part of the second covering member 160 covering the moving plate 130 may move with the moving plate 130 when the moving plate 130 moves. Another part of the second covering member 160 covering the connecting plate 140 may be coupled to the base 110. The other part of the second covering member 160 covering the connecting plate 140 may be fixed on the second surface 110*b* of the base 110 when the moving plate 130 moves.

According to an embodiment, a state of the moving plate 130 may be changed by the movement of the moving plate 130 with respect to the base 110. For example, the state of the moving plate 130 may include a first state in which the inner surface 131*a* of the first supporting member 131 and the second surface 110*b* of the base 110 face each other, and a second state in which a direction in which the inner surface 131*a* of the first supporting member 131 faces and a direction in which the second surface 110*b* of the base 110 faces are different from each other. According to an embodiment, in the first state of the moving plate 130, the direction in which the inner surface 131*a* of the first supporting member 131 faces and the direction in which the second surface 110*b* of the base 110 faces may be opposite to each other. In the first state of the moving plate 130, the inner surface 131*a* of the first supporting member 131 may be covered by the base 110 when viewing the base 110 from above. According to an embodiment, in the first state of the moving plate 130, the side surface 132*c* of the second supporting member 132 may face the supporting surface 110*c* of the base 110. For example, in the first state of the moving plate 130, the side surface 132*c* of the second supporting member 132 may be parallel to the supporting surface 110*c* of the base 110. According to an embodiment, in the first state of the moving plate 130, a direction in which the inner surface 130*c* of the moving plate 130 faces and a direction in which the first surface 110*a* of the base 110 faces may correspond to each other. For example, in the first state, the inner surface 131*a* of the first supporting member 131 and the second surface 110*b* may be parallel to each other. For example, in the first state of the moving plate 130, the direction in which the inner surface 130*c* of the moving plate 130 faces and the direction in which the first surface 110*a* of the base 110 faces may be the same. In the first state of the moving plate 130, the inner surface 130*c* of the moving plate 130 may not overlap the base 110 when viewing the base 110 from above. For example, in the first state of moving plate 130, the direction in which the first surface 110*a* of the base 110 faces and the direction in which the inner surface 132*a* of the second supporting member 132 faces may correspond to each other. For example, the inner surface 130*c* of the moving plate 130 may not be covered by the base 110 when viewing the base 110 from above. For example, in a second state of moving plate 130, the direction in which the inner surface 131*a* of the first supporting member 131 faces may be inclined with respect to the direction in which the second surface 110*b* faces.

A first magnet 170 may fix the second supporting member 132 in the first state of the moving plate 130. According to an embodiment, the first magnet 170 may be disposed inside the second supporting member 132. The first magnet 170 may face the electronic device disposed on the first surface 110*a* of the base 110 in the first state of the moving plate 130. As the first magnet 170 exerts attraction on the electronic device, the second supporting member 132 may not move with respect to the first supporting member 131 in the first state of the moving plate 130.

A second magnet 180 may couple the case 100 and the electronic device. The second magnet 180 may maintain a state in which the case 100 and the electronic device are coupled. According to an embodiment, the second magnet 180 may be disposed inside the base 110. For example, the second magnet 180 may face the electronic device in a state in which the case 100 and the electronic device are coupled to each other. As the second magnet 180 exerts attraction on the electronic device, the case 100 may maintain a coupled state with the electronic device.

According to an embodiment, in the second state of the moving plate 130, the moving plate 130 may be inclined with respect to the base 110. As the moving plate 130 is inclined with respect to the base 110, the case 100 may support the electronic device in an inclined state with respect to the ground in the second state of the moving plate 130. According to an embodiment, in the second state of the moving plate 130, as the second supporting member 132 moves with respect to the first supporting member 131, the second supporting member 132 may be movable between a first position in which the side surface 132*c* of the second supporting member 132 and the side surface 131*c* of the first supporting member 131 face each other and a second position in which the side surface 132*c* of the second supporting member 132 and the inner surface 131*a* of the first supporting member 131 face each other. For example, when the second supporting member 132 is in the first position, a form in which the case 100 supports the electronic device may be described with reference to FIG. 2A and FIG. 2B.

Figure 2A:
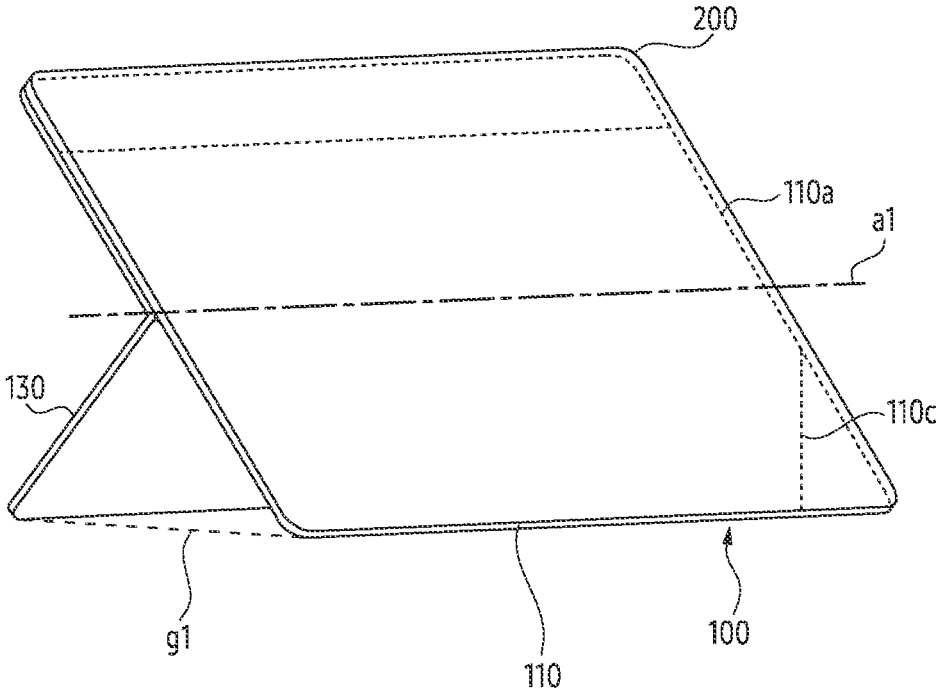
FIG. 2A is a perspective view of an exemplary case according to an embodiment in a second state.
Figure 2B:
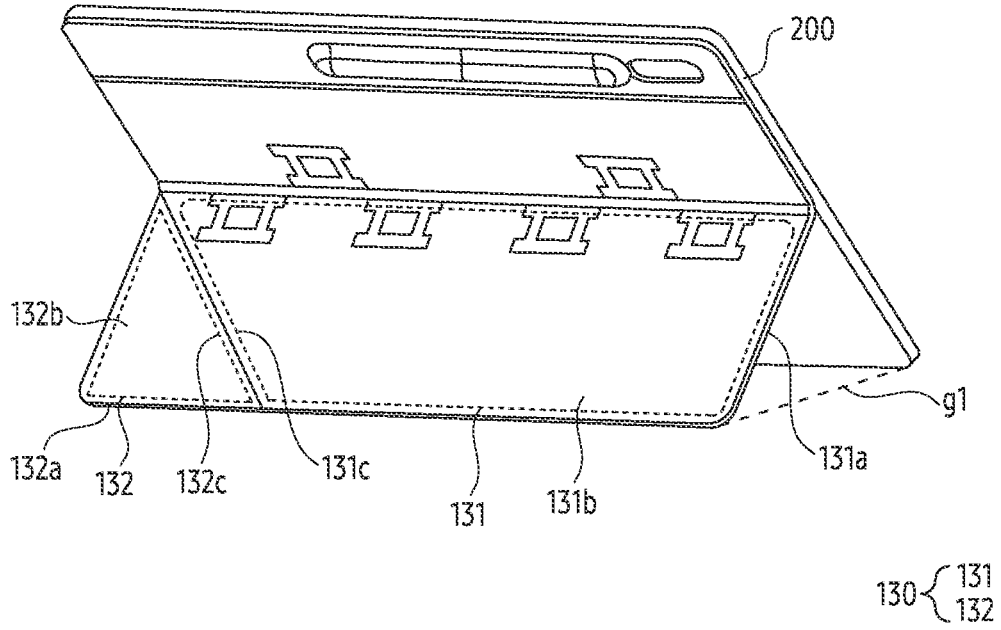
FIG. 2B is a perspective view of an exemplary case according to an embodiment in a second state.

FIG. 2A is a perspective view of a case 100 according to an embodiment in a second state, and FIG. 2B is a perspective view of a case 100 according to an embodiment in a second state.

FIGS. 2A and 2B are diagrams illustrating when a position of the second supporting member 132 is the first position in the second state of the moving plate 130.

Referring to FIGS. 2A and 2B, according to an embodiment, the case 100 may be detachably coupled to an electronic device 200. The electronic device 200 may be implemented as various devices capable of playing video content, such as a tablet and/or a smartphone, but is not limited thereto. According to an embodiment, the electronic device 200 may have a shape extending long in a direction parallel to the rotational axis al. For example, the length of the electronic device 200 extending in the direction parallel to the rotational axis al may be longer than the width of the electronic device 200 extending in the direction perpendicular to the rotational axis al.

According to an embodiment, the case 100 may be inclined with respect to the ground g1, or other surface, in the second state of the moving plate 130. In the second state of the moving plate 130, the electronic device 200 coupled to the case 100 may be inclined with respect to the ground g1. For example, in the second state of the moving plate 130, the moving plate 130 may be inclined with respect to the base 110. For example, in the second state of the moving plate 130, the moving plate 130 may be inclined with respect to the connecting plate 140.

According to an embodiment, when the state of the moving plate 130 is in the second state, the position of the second supporting member 132 may be the first position. When the second supporting member 132 is in the first position, the side surface 131*c* of the first supporting member 131 and the side surface 132*c* of the second supporting member 132 may face each other. For example, when the second supporting member 132 is in the first position, the side surface 131*c* of the first supporting member 131 and the side surface 132*c* of the second supporting member 132 may be parallel to each other. For example, when the second supporting member 132 is in the first position, the direction in which the side surface 131*c* of the first supporting member 131 faces may be opposite to the direction in which the side surface 132*c* of the second supporting member 132 faces. According to an embodiment, when the second supporting member 132 is in the first position, the inner surface 131*a* of the first supporting member 131 may be parallel to the inner surface 132*a* of the second supporting member 132. For example, when the second supporting member 132 is in the first position, the direction in which the inner surface 131*a* of the first supporting member 131 faces may correspond to the direction in which the inner surface 132*a* of the second supporting member 132 faces. According to an embodiment, when the second supporting member 132 is in the first position, the outer surface 131*b* of the first supporting member 131 may be parallel to the outer surface 132*b* of the second supporting member 132. For example, when the second supporting member 132 is in the first position, the direction in which the outer surface 131*b* of the first supporting member 131 faces may be parallel to the direction in which the outer surface 132*b* of the second supporting member 132 faces.

According to an embodiment, when the second supporting member 132 is in the first position, the first supporting member 131 and the second supporting member 132 of the moving plate 130 may be in contact with the ground g1. When the second supporting member 132 is in the first position, the angle between the electronic device 200 and the ground g1 may correspond to the angle between the moving plate 130 and the base 110. For example, when the second supporting member 132 is in the first position, the angle between the electronic device 200 and the ground g1 may be set based on the direction between the inner surface 131*a* of the first supporting member 131 and the direction of the second surface 110*b* of the base 110.

According to an embodiment, in the second state of the moving plate 130, the second supporting member 132 may be moved with respect to the first supporting member 131. For example, the position of the second supporting member 132 may change from the first position to the second position as the second supporting member 132 moves with respect to the first supporting member 131. The form in which the case 100 supports the electronic device 200 when the second supporting member 132 is in the second position may be described with reference to FIG. 3A and FIG. 3B.

Figure 3A:
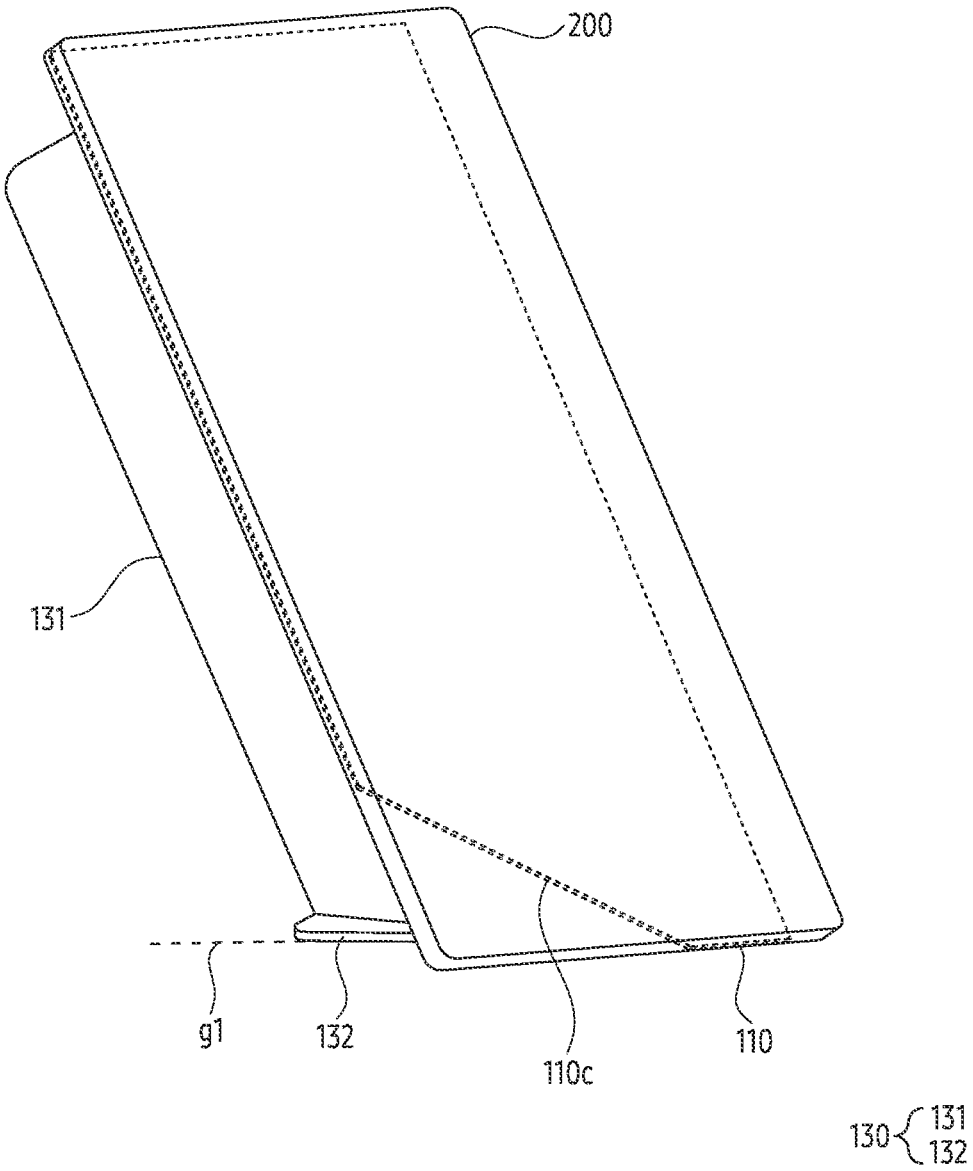
FIG. 3A is a perspective view of an exemplary case according to an embodiment in a second state.
Figure 3B:
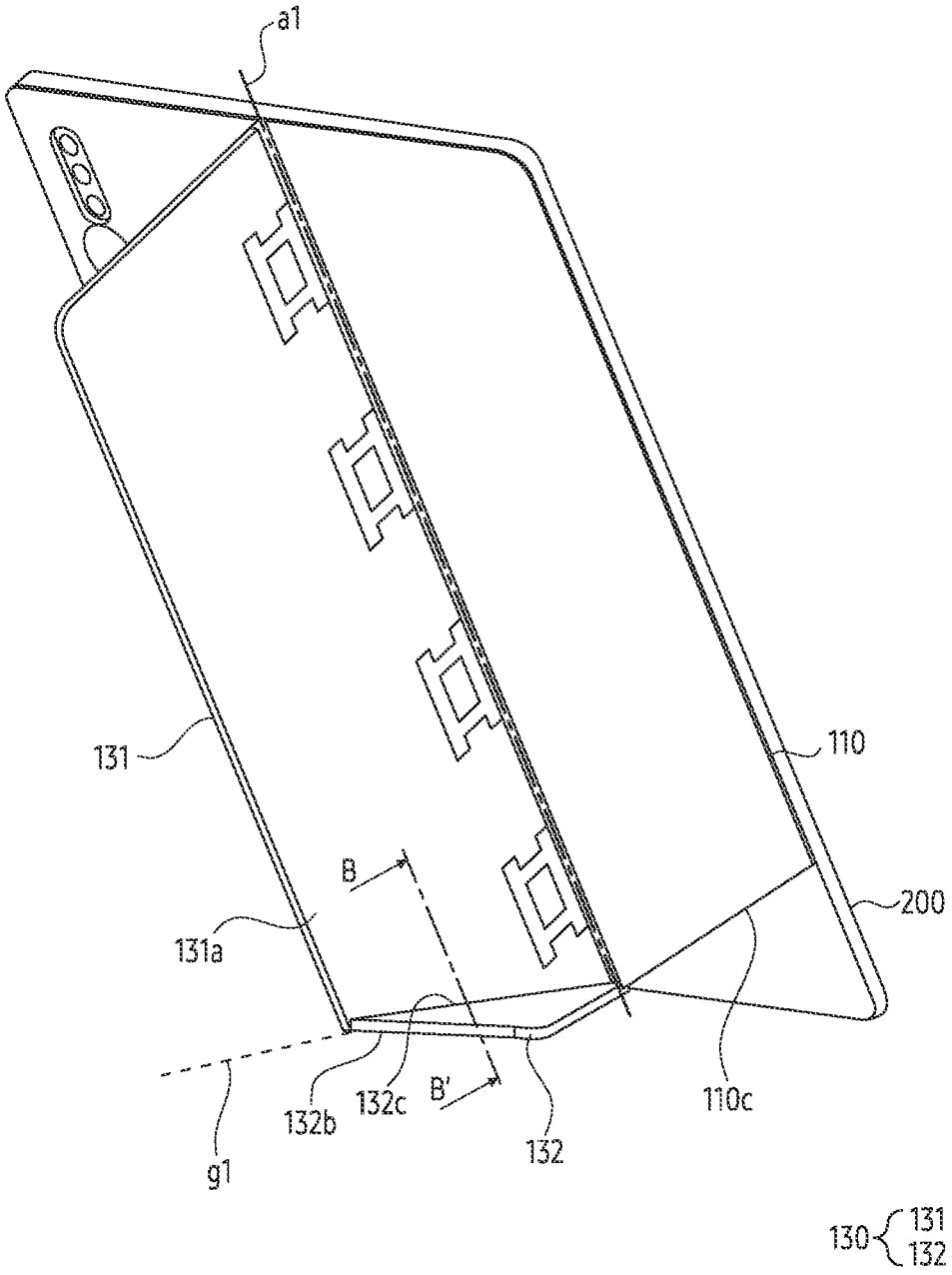
FIG. 3B is a perspective view of an exemplary case according to an embodiment in a second state.

FIG. 3A is a perspective view of an exemplary case according to an embodiment in a second state, and FIG. 3B is a perspective view of an exemplary case according to an embodiment in a second state.

FIGS. 3A and 3B are diagrams illustrating when the position of the second supporting member 132 is the second position in the second state of the moving plate 130.

Referring to FIGS. 3A and 3B, according to an embodiment, when the position of the second supporting member 132 is the second position, the side surface 132*c* of the second supporting member 132 may be disposed on the inner surface 132*a* of the first supporting member 131. When the position of the second supporting member 132 is the second position, the side surface 132*c* of the second supporting member 132 may face the inner surface 132*a* of the first supporting member 131. For example, when the position of the second supporting member 132 is in the second position, the direction in which the side surface 132*c* of the second supporting member 132 faces may be opposite to the direction in which the inner surface 132*a* of the first supporting member 131 faces. According to an embodiment, when the position of the second supporting member 132 is the second position, the outer surface 132*b* of the second supporting member 132 may face the ground g1 on which the electronic device 200 is disposed. When the position of the second supporting member 132 is the second position, the side surface 131*c* of the first supporting member 131 may face the ground g1 on which the electronic device 200 is disposed.

According to an embodiment, an angle between the electronic device 200 and the ground g1 when the position of the second supporting member 132 is in the second position may be different from an angle between the electronic device 200 and the ground g1 when the position of the second supporting member 132 is in the first position. When the position of the second supporting member 132 is in the second position, an angle between the electronic device 200 and the ground g1 may correspond to an angle of the side surface 132*c* of the rotational axis al and the second supporting member 132. For example, when the position of the second supporting member 132 is the second position, the angle between the electronic device 200 and the ground g1 may correspond to an angle between the rotational axis al and the supporting surface 110*c* of the base 110. For example, when the position of the second supporting member 132 is the second position, the angle between the electronic device 200 and the ground g1 may correspond to an angle between the side surface 131*c* of the first supporting member 131 and the rotational axis al. As the second supporting member 132 may move to the first position or the second position in the second state of the moving plate 130, the case 100 may support the electronic device 200 while forming various angles with the ground g1. As the angle between the case 100 and the ground g1 changes in various ways, the electronic device 200 may be mounted while forming various angles with respect to the ground g1.

According to an embodiment, the case 100 may support the electronic device 200 so that the electronic device 200 may provide visual information of various ratios to the user. For example, referring to FIG. 2A, when the second supporting member 132 is in the first position in the second state of the moving plate 130, the case 100 may support the electronic device 200 so that the rotational axis al is parallel to the ground g1. For example, referring to FIG. 3B, when the second supporting member 132 is the second position in the second state of the moving plate 130, the case 100 may support the electronic device 200 so that the rotational axis al is inclined with respect to the ground g1.

According to an embodiment, in the second state of the moving plate 130, the supporting surface 110*c* of the base 110 may be exposed to the outside of the case 100. When the position of the second supporting member 132 is the first position and the second position, the supporting surface 110*c* of the base 110 may be exposed to the outside of the case 100. For example, in the second state of the moving plate 130, the supporting surface 110*c* of the base 110 may not be covered by the second supporting member 132.

As described above, according to an embodiment, the case 100 may provide a structure capable of supporting the electronic device 200 in various angles by the second supporting member 132 movable with respect to the first supporting member 131. According to an embodiment, in the second state of the moving plate 130, since the second supporting member 132 may be moved to the first position and the second position, the case 100 may provide a structure in which the electronic device 200 and the ground g1 may form various angles.

Figure 4A:
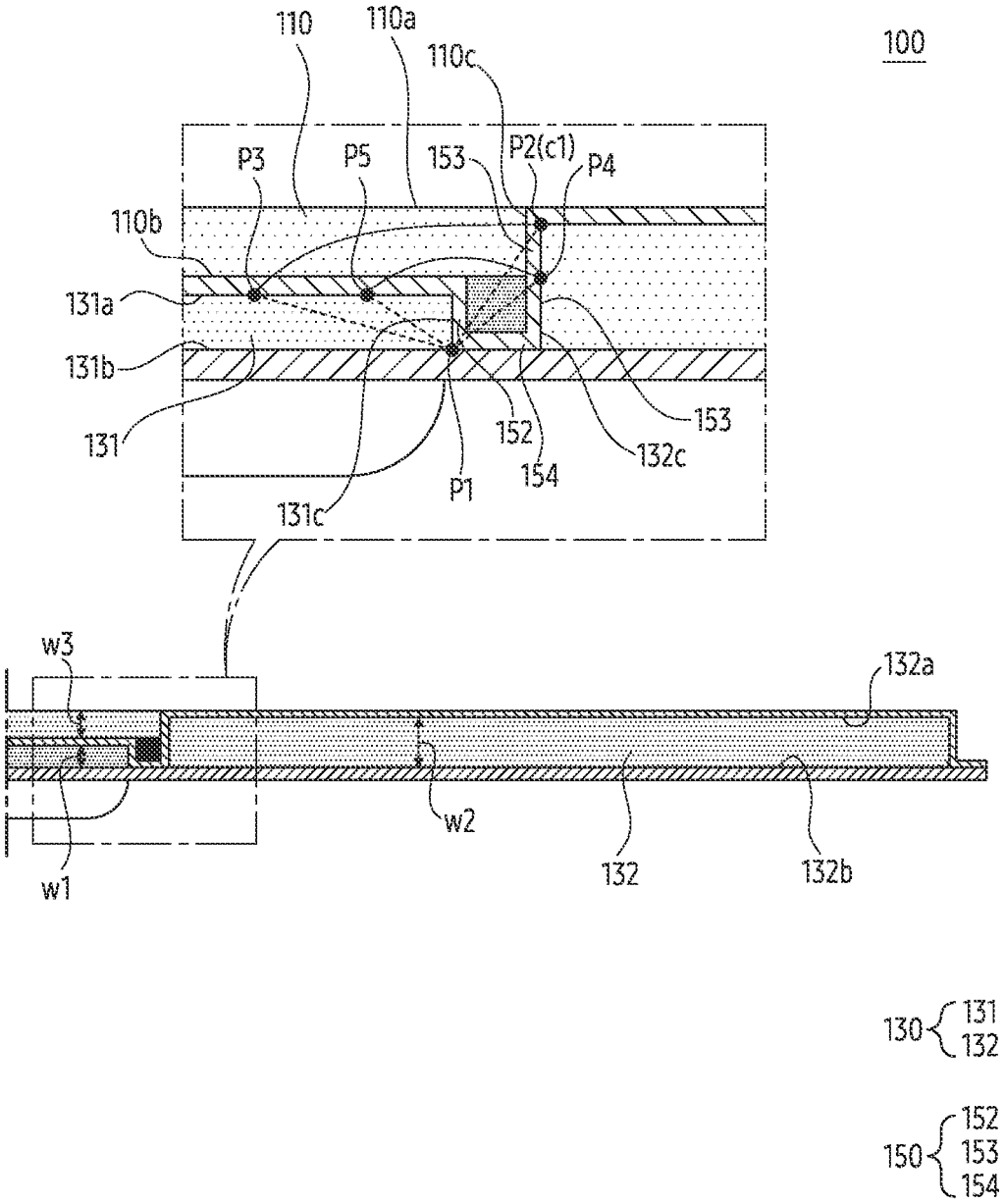
FIG. 4A is a cross-sectional view illustrating an example in which an exemplary case according to an embodiment in a first state is cut along A-A' of FIG. 1A.
Figure 4B:
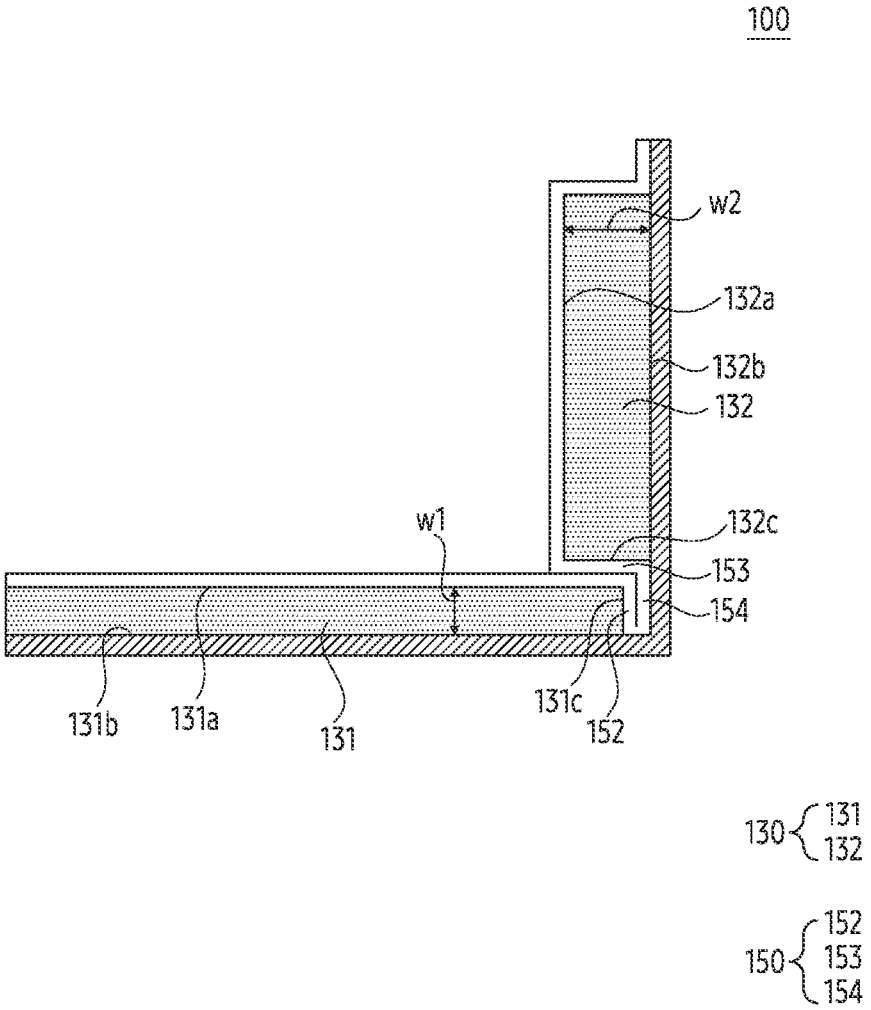
FIG. 4B is a cross-sectional view illustrating an example in which an exemplary case in according to an embodiment in a second state is cut along B-B' of FIG. 3B.

FIG. 4A is a cross-sectional view illustrating an example in which an exemplary case according to an embodiment in a first state is cut along A-A' of FIG. 1A, and FIG. 4B is a cross-sectional view illustrating an example in which an exemplary case in according to an embodiment in a second state is cut along B-B' of FIG. 3B.

FIG. 4B is a diagram illustrating a cross section of the case 100 when the position of the second supporting member 132 is the second position in the second state of the moving plate 130.

Referring to FIG. 4A and FIG. 4B, according to an embodiment, when the position of the second supporting member 132 is the second position in the second state of the moving plate 130, the second supporting member 132 may be perpendicular to the first supporting member 131. For example, when the position of the second supporting member 132 is the second position in the second state of the moving plate 130, the inner surface 132*a* of the second supporting member 132 may be perpendicular to the inner surface 132*a* of the first supporting member 131. As the second supporting member 132 and the first supporting member 131 are perpendicular to each other when the position of the second supporting member 132 is the second position in the second state of the moving plate 130, the case 100 may stably support an electronic device (e.g., the electronic device 200 of FIG. 2A and FIG. 2B).

According to an embodiment, the first covering member 150 may include any of a first extending portion 152, a second extending portion 153, and a third extending portion 154. The first extending portion 152 may be disposed on the side surface 131*c* of the first supporting member 131 facing the side surface 132*c* of the second supporting member 132 in the first state of the moving plate 130. The first extending portion 152 may be in contact with the side surface 131*c* of the first supporting member 131. According to an embodiment, the first extending portion 152 may extend on the side surface 131*c* of the first supporting member 131. For example, the first extending portion 152 may extend on the side surface 131*c* of the first supporting member 131 in a direction parallel to the side surface 131*c* of the first supporting member 131.

The second extending portion 153 may be disposed on the side surface 132*c* of the second supporting member 132. The second extending portion 153 may be in contact with the side surface 132*c* of the second supporting member 132. According to an embodiment, the second extending portion 153 may extend on the side surface 132*c* of the second supporting member 132. For example, the second extending portion 153 may extend on the side surface 132*c* of the second supporting member 132 in a direction parallel to the side surface 132*c* of the second supporting member 132. According to an embodiment, in the first state of the moving plate 130, the second extending portion 153 may be in contact with the supporting surface 110*c* of the base 110. When the position of the second supporting member 132 is the second position in the second state of the moving plate 130, the second extending portion 153 may face the inner surface 131*a* of the first supporting member 131.

The third extending portion 154 may connect the first extending portion 152 and the second extending portion 153. According to an embodiment, the third extending portion 154 may be disposed between the first supporting member 131 and the second supporting member 132. For example, the third extending portion 154 may be in contact with the second covering member 160 between the first supporting member 131 and the second supporting member 132. According to an embodiment, the third extending portion 154 may face the second surface 110*b* of the base 110 in the first state of the moving plate 130. For example, the third extending portion 154 may be spaced apart from the second surface 110*b* of the base 110 while facing the second surface 110*b* of the base 110 in the first state of the moving plate 130. When the position of the second supporting member 132 is the second position in the second state of the moving plate 130, the third extending portion 154 may face the first extending portion 152. For example, in the second state of the moving plate 130, as the side surface 132*c* of the second supporting member 132 faces the inner surface 131*a* of the first supporting member 131, the third extending portion 154 may contact the first extending portion 152.

According to an embodiment, the first covering member 150 may be deformable as the second supporting member 132 moves with respect to the first supporting member 131. For example, as the second supporting member 132 moves with respect to the first supporting member 131, the third extending portion 154 may be deformed. According to an embodiment, the length of the third extending portion 154 may be shorter than or equal to the length of the first extending portion 152. For example, in the first state of the moving plate 130, the length of the third extending portion 154 may be shorter than or equal to the length of the first extending portion 152. When the second supporting member 132 moves with respect to the first supporting member 131 so that the side surface 132*c* of the second supporting member 132 faces the inner surface 131*a* of the first supporting member 131, the length of the third extending portion 154 may increase as the third extending portion 154 is deformed. When the side surface 132*c* of the second supporting member 132 faces the inner surface 131*a* of the first supporting member 131, as the length of the third extending portion 154 increases, the length of the third extending portion 154 may correspond to the length of the first extending portion 152. When the length of the third extending portion 154 is longer than the first extending portion 152 in the first state of the moving plate 130, when the position of the second supporting member 132 is the second position in the second state of the moving plate 130, the second supporting member 132 may be inclined with respect to the first supporting member 131. When the second supporting member 132 is inclined with respect to the first supporting member 131, the case 100 may be difficult to stably support the electronic device 200. According to an embodiment, since the length of the third extending portion 154 is shorter than or equal to the length of the first extending portion 152, when the position of the second supporting member 132 is the second position in the second state of the moving plate 130, the case 100 may provide a structure capable of stably supporting the electronic device 200.

According to an embodiment, a thickness w2 of the second supporting member 132 may be thicker than a thickness w1 of the first supporting member 131. For example, a difference in thickness between the second supporting member 132 and the first supporting member 131 may correspond to a thickness w3 of the base 110. As the thicknesses of the second supporting member 132 and the first supporting member 131 are different from each other, in the first state of the moving plate 130, a step may not be formed between one surface 150*a* of the first covering member 150 disposed on the inner surface 132*a* of the second supporting member 132 and the first surface 110*a* of the base 110. For example, in the first state of moving plate 130, one surface 150*a* of the first covering member 150 disposed on the inner surface 132*a* of the second supporting member 132 and the first surface 110*a* of the base 110 may define one plane. As one surface 150*a* of the first covering member 150 defines one plane in the first state of the moving plate 130, the case 100 according to an embodiment may stably support the electronic device 200.

According to an embodiment, as the thickness w2 of the second supporting member 132 is thicker than the thickness w1 of the first supporting member 131, the length of the third extending portion 154, which increases by the movement of the second supporting member 132 with respect to the first supporting member 131, may increase. For example, when the second supporting member 132 moves with respect to the first supporting member 131, a corner of the second supporting member 132 may move from a first point p2 to a second point p3 by rotating based on one end p1 of the third extending portion 154. Compared to a case that the second supporting member 132 is thicker than the first supporting member 131, the corner of the second supporting member 132 may be disposed closer to one end p1 of the third extending portion 154 when the thickness of the second supporting member 132 is less than or equal to the thickness of the first supporting member 131. When the thickness of the second supporting member 132 is less than or equal to the thickness of the first supporting member 131, a corner cl of the second supporting member 132 may move from a third point p4 to a fourth point p5 as the second supporting member 132 moves with respect to the first supporting member 131. As a corner of the second supporting member 132 is disposed closer to the one end p1 of the third extending portion 154, the moving distance of the corner cl of the second supporting member 132 becomes shorter, the degree to which the length of the third extending portion 154 moving with the second supporting member 132 is extended may be reduced. When the position of the second supporting member 132 is the second position in the second state of the moving plate 130, as the degree of extension of the length of the third extending portion 154 is reduced, the force of the third extending portion 154 pressing the second supporting member 132 in the direction facing the first supporting member 131 may be reduced. Since the second supporting member 132 cannot maintain a state perpendicular to the first supporting member 131 when the force of the third extending portion 154 pressing the second supporting member 132 is reduced, the case 100 may be difficult to stably support the electronic device 200. The case 100 according to an embodiment may provide a structure in which the second supporting member 132 can stably maintain a state perpendicular to the first supporting member 131 by the second supporting member 132 thicker than the first supporting member 131.

As described above, according to an embodiment, since the length of the third extending portion 154 is less than or equal to the length of the first extending portion 152, the case 100 may provide a structure capable of stably supporting the electronic device 200. According to an embodiment, the case 100 can provide a structure in which the case 100 can stably support the electronic device 200 by the second supporting member 132 having a thickness thicker than a thickness of the first supporting member 131.

The case may include a structure capable of supporting the electronic device in a coupled state with the electronic device. For example, the case may include a structure capable of supporting the electronic device in an inclined state with respect to the ground. The user of the electronic device may receive content (e.g., images) through the electronic device while the electronic device is supported by the case. As the ratio of screens suitable for content is diversified, the case may require a structure capable of holding the electronic device from various angles.

According to an embodiment, a case (e.g., the case 100 of FIG. 1A and FIG. 1B) detachably coupled to an electronic device (e.g., the electronic device 200 of FIG. 2A and FIG. 2B) may comprise a base (e.g., the base 110 of FIG. 1A and FIG. 1B) including a first surface (e.g., the first surface 110*a* of FIG. 1B) supporting the electronic device, a second surface (e.g., the second surface 110*b* of FIG. 1B) opposite to the first surface, and the supporting surface (e.g., the supporting surface 110*c* of FIG. 1A and FIG. 1B) connecting the first surface and the second surface. According to an embodiment, the case may comprise a moving plate (e.g., the moving plate 130 of FIG. 1A and FIG. 1B) including a first supporting member (e.g., the first supporting member 131 of FIG. 1A and FIG. 1B) and a second supporting member (e.g., the second supporting member 132 of FIG. 1A and FIG. 1B) thicker than the first supporting member and movable with respect to the first supporting member, the moving plate is rotatable about the base with respect to a rotational axis (e.g., the rotational axis al of FIG. 1A and FIG. 1B). According to an embodiment, a state of the moving plate may include a first state in which an inner surface (e.g., the inner surface 131*a* of the first supporting member 131 of FIG. 1B) of the first supporting member and the second surface are parallel each other and a second state in which a direction the inner surface facing is inclined with respect to a direction the second surface facing. According to an embodiment, in the first state, a side surface (e.g., the side surface 132*c* of the second supporting member 132 of FIG. 1B) of the second supporting member and the supporting surface inclined with respect to the rotational axis may face each other. According to an embodiment, in the second state, the side surface (e.g., the side surface 131*c* of the first supporting member 131 of FIG. 1B) of the second supporting member may face the inner surface of the first supporting member or a side surface of the first supporting member perpendicular to the inner surface of the first supporting member, by a movement of the second supporting member with respect to the first supporting member.

According to an embodiment, the case may provide a structure capable of supporting the electronic device in various angles by a second supporting member movable to the first position and the second position in the second state of the moving plate.

According to an embodiment, a thickness of the base may correspond to a difference between a thickness of the second supporting member and a thickness of the first supporting member.

According to an embodiment, since the thickness of the second supporting member is thicker than the thickness of the first supporting member, the case may provide a structure capable of stably supporting the electronic device.

According to an embodiment, the side surface of the first supporting member may be parallel to the supporting surface.

According to an embodiment, the case may support the electronic device in an inclined state with respect to the ground by a first supporting member extending in an inclined direction with respect to a rotational axis.

According to an embodiment, wherein in the first state, a direction the first surface facing and a direction an inner surface (e.g., the inner surface 132*a* of the second supporting member 132 of FIG. 1B) of the second supporting member perpendicular to the side surface of the second supporting member may correspond each other.

According to an embodiment, the supporting surface may be exposed to outside of the case in the second state.

According to an embodiment, since the case is exposed to the outside of the case in the second state and faces the side surface of the second supporting member in the first state, the case may have a shape corresponding to the shape of the electronic device by the supporting surface.

According to an embodiment, the case may include a connecting plate (e.g., the connecting plate 140 of FIG. 1A and FIG. 1B) disposed on the second surface. According to an embodiment, the case may include a hinge (e.g., at least one hinge (120) of FIG. 1A and FIG. 1B) disposed between the first supporting member and the connecting plate, and defining the rotational axis.

According to an embodiment, the case may provide a structure in which the moving plate can support the electronic device in various angles by a hinge defining the rotational axis.

According to an embodiment, the case may include an accommodating groove (e.g., the accommodating groove 141 of FIG. 1A and FIG. 1B) disposed on the connecting plate, for accommodating an electronic pen different from the electronic device.

According to an embodiment, the case may provide a structure capable of enhancing the portability of the electronic device and a pen by the accommodating groove capable of accommodating the electronic pen.

According to an embodiment, the case may include a first magnet (e.g., the first magnet 170 of FIG. 1A and FIG. 1B) disposed in the second supporting member and facing the electronic device in the first state.

According to an embodiment, the case may provide a structure capable of fixing the second supporting member in the first state by the first magnet facing the electronic device in the first state of the moving plate.

According to an embodiment, the side surface of the second supporting member may extend in a direction inclined with respect to the rotational axis.

According to an embodiment, the case may support the electronic device in an inclined state with respect to the ground by the side surface of the second supporting member inclined with respect to the rotational axis.

According to an embodiment, the moving plate may include a first covering member (e.g., a first covering member 150 of FIG. 1B) covering the first supporting member and the second supporting member and facing the second surface in the first state. According to an embodiment, the first covering member may include a first extending portion (e.g., the first extending portion 152 of FIG. 4A and FIG. 4B) extending on a side surface of the first supporting member facing the side surface (e.g., the side surface 131*c* of the first supporting member 131 of FIG. 1B) of the second supporting member in the first state. According to an embodiment, the first covering member may include a second extending portion (e.g., the second extending portion 153 of FIG. 4A and FIG. 4B) extending on the side surface of the second supporting member. According to an embodiment, the first covering member may include a third extending portion (e.g., the third extending portion 154 of FIG. 4A and FIG. 4B) extending between the first extending portion and the second extending portion. According to an embodiment, a length of the third extending portion may be equal to or shorter than a length of the first extending portion.

According to an embodiment, the case may provide a structure capable of stably supporting the electronic device by a third extending portion having a length equal to or less than the length of the first extending portion.

According to an embodiment, third extending portion may face the second surface and may be spaced apart from the second surface in the first state.

According to an embodiment, the case may provide a structure in which the second supporting member can move with respect to the first supporting member by the third extending portion connecting the first supporting member and the second supporting member.

According to an embodiment, the second extending portion may be in contact with the supporting surface in the first state.

According to an embodiment, the case may provide a structure capable of supporting the electronic device by the second extending portion that moves according to the movement of the second supporting member.

According to an embodiment, the third extending portion may be deformable when the second supporting member moves with respect to the first supporting member. According to an embodiment, the third extending portion may be in contact with the first extending portion as the side surface of the second supporting member faces the inner surface of the first supporting member in the second state.

According to an embodiment, the case may provide a structure capable of supporting the electronic device in various angles by the third extending portion deformable by the movement of the second supporting member.

According to an embodiment, the case may include a second covering member (e.g., the second covering member 160 of FIG. 1A and FIG. 1B) covering an outer surface of the first supporting member opposite to the inner surface of the first supporting member, and in contact with the third extending portion between the first supporting member and the second supporting member.

According to an embodiment, the case may provide a structure in which the second supporting member is movable with respect to the first supporting member by the second covering member covering the first supporting member and the second supporting member.

According to an embodiment, the case may include a second magnet (e.g., the second magnet 180 of FIG. 1B) disposed in the base for coupling the electronic device and the case.

According to an embodiment, the case may provide a structure capable of maintaining a coupled state to the electronic device by a second magnet facing the electronic device.

According to an embodiment, a case (e.g., the case 100 of FIG. 1A and FIG. 1B) detachably coupled to an electronic device (e.g., the electronic device 200 of FIG. 2A and FIG. 2B) may comprise a base (e.g., the base 110 of FIG. 1A and FIG. 1B) including a first surface (e.g., the first surface 110*a* of FIG. 1A and FIG. 1B) supporting the electronic device, a second surface (e.g., the second surface 110*b* of FIG. 1B) opposite to the first surface, and the supporting surface (e.g., the supporting surface 110*c* of FIG. 1A and FIG. 1B) connecting the first surface and the second surface. According to an embodiment, the case may comprise a hinge (e.g., at least one hinge 120 of FIG. 1A and FIG. 1B) disposed on the second surface and defining a rotational axis (e.g., the rotational axis al of FIG. 1A and FIG. 1B). According to an embodiment, the case may comprise a moving plate (e.g., the moving plate 130 of FIG. 1A and FIG. 1B) including a first supporting member (e.g., the first supporting member 131 of FIG. 1A and FIG. 1B) and a second supporting member (e.g., the second supporting member 132 of FIG. 1A and FIG. 1B) thicker than the first supporting member and movable with respect to the first supporting member, the moving plate is rotatable about the base with respect to a rotational axis (e.g., the rotational axis al of FIG. 1A and FIG. 1B) and the moving plate is coupled to a part of the hinge. According to an embodiment, the case may comprise a connecting plate (e.g., the connecting plate 140 of FIG. 1A and FIG. 1B) to be coupled to another part of the hinge. According to an embodiment, a state of the moving plate may include a first state in which an inner surface (e.g., the inner surface 131*a* of the first supporting member 131 of FIG. 1B) of the first supporting member and the second surface are parallel each other and a second state in which a direction the inner surface facing is inclined with respect to a direction the second surface facing. According to an embodiment, in the first state, a side surface (e.g., the side surface 132*c* of the second supporting member 132 of FIG. 1B) of the second supporting member and the supporting surface extending in a direction inclined with respect to the rotational axis may face each other. According to an embodiment, in the second state, the side surface (e.g., the side surface 131*c* of the first supporting member 131 of FIG. 1B) of the second supporting member may face the inner surface of the first supporting member or a side surface of the first supporting member perpendicular to the inner surface, by a movement of the second supporting member with respect to the first supporting member.

According to an embodiment, the case may provide a structure capable of supporting the electronic device in various angles by a second supporting member movable to the first position and the second position in the second state of the moving plate.

According to an embodiment, a thickness of the base may correspond to a difference between a thickness of the second supporting member and a thickness of the first supporting member.

According to an embodiment, since the thickness of the second supporting member is thicker than the thickness of the first supporting member, the case may provide a structure capable of stably supporting the electronic device.

According to an embodiment, the side surface of the first supporting member may be parallel to the supporting surface.

According to an embodiment, the case may support the electronic device in an inclined state with respect to the ground by a first supporting member extending in an inclined direction with respect to a rotational axis.

According to an embodiment, the case may include a first magnet (e.g., the first magnet 170 of FIG. 1A and FIG. 1B) disposed in the second supporting member and facing the electronic device in the first state.

According to an embodiment, the case may provide a structure capable of fixing the second supporting member in the first state by the first magnet facing the electronic device in the first state of the moving plate.

According to an embodiment, the moving plate may include a first covering member (e.g., the first covering member 150 of FIG. 1B) covering the first supporting member and the second supporting member and facing the second surface in the first state. According to an embodiment, the first covering member may include a first extending portion (e.g., the first extending portion 152 of FIG. 4A and FIG. 4B) extending on a side surface (e.g., side surface 131*c* of the first supporting member 131 of FIG. 1B) of the first supporting member facing the side surface of the second supporting member in the first state. According to an embodiment, the first covering member may include a second extending portion (e.g., the second extending portion 153 of FIG. 4A and FIG. 4B) extending on the side surface of the second supporting member. According to an embodiment, the first covering member may include a third extending portion (e.g., the third extending portion 154 of FIG. 4A and FIG. 4B) extending between the first extending portion and the second extending portion. According to an embodiment, a length of the third extending portion may be equal to or shorter than a length of the first extending portion.

According to an embodiment, the case may provide a structure capable of stably supporting the electronic device by a third extending portion having a length equal to or less than the length of the first extending portion.

The electronic device according to various embodiments disclosed in the present document may be various types of devices. The electronic device may include, for example, a portable communication device (e.g., a smartphone), a computer device, a portable multimedia device, a portable medical device, a camera, a wearable device, or a home appliance. The electronic device according to an embodiment of the present document is not limited to the above-described devices.

The various embodiments and terms used herein are not intended to limit the technical features described herein to specific embodiments and should be understood to include various modifications, equivalents, or substitutes of the embodiment. With respect to the description of the drawings, similar reference numerals may be used for similar or related components. The singular form of the noun corresponding to the item may include one or more of the items unless clearly indicated differently in a related context. In this document, each of the phrases such as "A or B", "at least one of A and B", "at least one of A, B and C", "at least one of A, B, or C", and "at least one of A, B, or C" may include any one of the phrases together, or all possible combinations thereof. Terms such as "first", "second", or "second", or "second" may be used simply to distinguish a corresponding component from another corresponding component, and are not limited to other aspects (e.g., importance or order). When some (e.g., the first) component is referred to as "coupled" or "connected" in another (e.g., the second) component, with or without the term "functional" or "communicatively", it means that some of the components can be connected directly (e.g., wired), wirelessly, or through a third component.

According to various embodiments, each of the above-described components (e.g., a module or a program) may include a single object or a plurality of objects, and some of the plurality of objects may be separated and disposed in other components. According to various embodiments, one or more components or operations of the above-described corresponding components may be omitted, or one or more other components or operations may be added. Alternatively, or additionally, a plurality of components (e.g., modules or programs) may be integrated into one component. In this case, the integrated component may perform one or more functions of each of the components in the same or similar manner as those performed by the corresponding component among the plurality of components before the integration. According to various embodiments, operations performed by a module, a program, or other components may be executed sequentially, in parallel, repeatedly, or heuristic, performed in a different order, omitted, or one or more other operations may be added.

What is claimed is:

1. A case configured to be detachably coupled to an electronic device, the case comprising:

a base comprising a first surface configured to support the electronic device, a second surface opposite to the first surface, and a supporting surface connecting the first surface and the second surface; and a moving plate comprising a first supporting member and a second supporting member that is thicker than the first supporting member and configured to be movable with respect to the first supporting member, the moving plate configured to be rotatable with respect to the base about a rotational axis to position the moving plate in a first state with respect to the base and position the moving plate in a second state with respect to the base, wherein, in the first state, an inner surface of the first supporting member and the second surface of the base are parallel to each other, and a side surface of the second supporting member and the supporting surface, which is inclined with respect to the rotational axis, face each other, and wherein, in the second state, a direction in which the inner surface of the first supporting member is facing is inclined with respect to a direction in which the second surface is facing, and wherein, in the second state, by a movement of the second supporting member with respect to the first supporting member, the side surface of the second supporting member faces the inner surface of the first supporting member or a side surface of the first supporting member perpendicular to the inner surface of the first supporting member.

2. The case of claim 1, wherein a thickness of the base corresponds to a difference between a thickness of the second supporting member and a thickness of the first supporting member.

3. The case of claim 1, wherein the side surface of the first supporting member is parallel to the supporting surface.

4. The case of claim 1, wherein, in the first state, the first surface and an inner surface of the second supporting member, that is perpendicular to the side surface of the second supporting member, face in a same direction.

5. The case of claim 1, wherein, in the second state, the supporting surface is exposed to an outside of the case.

6. The case of claim 1, wherein the case further comprises:

a connecting plate disposed on the second surface; and a hinge disposed between the first supporting member and the connecting plate, the hinge defining the rotational axis.

7. The case of claim 6, wherein the connecting plate comprises an accommodating groove configured to accommodate an electronic pen different from the electronic device.

8. The case of claim 1, wherein the case further comprises a first magnet disposed in the second supporting member, and wherein, in the first state, the first magnet faces the electronic device when the electronic device is detachably coupled to the case.

9. The case of claim 1, wherein the side surface of the second supporting member is inclined with respect to the rotational axis.

10. The case of claim 1, wherein the moving plate comprises a first covering member covering the first supporting member and the second supporting member, wherein, in the first state, the first covering member faces the second surface, wherein the first covering member comprises:

a first extending portion extending on the side surface of the first supporting member facing, in the first state, the side surface of the second supporting member;

a second extending portion extending on the side surface of the second supporting member; and a third extending portion extending between the first extending portion and the second extending portion, and wherein a length of the third extending portion is equal to or shorter than a length of the first extending portion.

11. The case of claim 1, wherein, in the first state, the third extending portion faces the second surface and is spaced apart from the second surface.

12. The case of claim 1, wherein, in the first state, the second extending portion contacts the supporting surface.

13. The case of claim 1, wherein the third extending portion is configured to deform when the second supporting member is moved with respect to the first supporting member, and wherein, in the second state, the third extending portion contacts the first extending portion as the side surface of the second supporting member faces the inner surface of the first supporting member.

14. The case of claim 10, wherein the case further comprises a second covering member covering an outer surface of the first supporting member opposite to the inner surface of the first supporting member, and wherein the second covering member contacts the third extending portion between the first supporting member and the second supporting member.

15. The case of claim 1, wherein the case further comprises a second magnet disposed in the base and configured to couple the electronic device and the case.

16. A case configured to be detachably coupled to an electronic device, the case comprising:

a base comprising a first surface configured to support the electronic device, a second surface opposite to the first surface, and a supporting surface connecting the first surface and the second surface;

a hinge disposed on the second surface and defining a rotational axis;

a moving plate comprising a first supporting member and a second supporting member that is thicker than the first supporting member and configured to be movable with respect to the first supporting member, the moving plate coupled to a first part of the hinge and configured to be rotatable with respect to the base about the rotational axis to position the moving plate in a first state with respect to the base and position the moving plate in a second state with respect to the base; and a connecting plate coupled to a second part of the hinge, wherein, in the first state, an inner surface of the first supporting member and the second surface of the base are to parallel each other, and a side surface of the second supporting member and the supporting surface, which is inclined with respect to the rotational axis, face each other, and wherein, in the second state, a direction in which the inner surface of the first supporting member is facing is inclined with respect to a direction in which the second surface is facing, and wherein, in the second state, by a movement of the second supporting member with respect to the first supporting member, the side surface of the second supporting member faces the inner surface of the first supporting member or a side surface of the first supporting member perpendicular to the inner surface.

17. The case of claim 16, wherein a thickness of the base corresponds to a difference between a thickness of the second supporting member and a thickness of the first supporting member.

18. The case of claim 16, wherein, in the second state, the supporting surface is exposed to an outside of the case.

19. The case of claim 16, wherein the case further comprises a first magnet disposed in the second supporting member, and wherein, in the first state, the first magnet faces the electronic device when the electronic device is detachably coupled to the case.

20. The case of claim 16, wherein the moving plate comprises a first covering member covering the first supporting member and the second supporting member, the first covering member faces the second surface, wherein the first covering member comprises:

a first extending portion extending on the side surface of the first supporting member facing, in the first state, the side surface of the second supporting member;

a second extending portion extending on the side surface of the second supporting member; and a third extending portion extending between the first extending portion and the second extending portion, and wherein a length of the third extending portion is equal to or shorter than a length of the first extending portion.

* * * * *